United States Patent [19]

Crow

[11] Patent Number: 4,550,789

[45] Date of Patent: Nov. 5, 1985

[54] HYDRAULIC JARRING TOOL

[75] Inventor: Morgan L. Crow, Dallas, Tex.

[73] Assignee: Dresser Industries, Inc., Dallas, Tex.

[21] Appl. No.: 592,637

[22] Filed: Mar. 23, 1984

[51] Int. Cl.[4] ..... E21B 31/113

[52] U.S. Cl. ..... 175/297; 166/178

[58] Field of Search ..... 175/296, 297; 166/178

[56] References Cited

U.S. PATENT DOCUMENTS

| | | | |
|---|---|---|---|
| 2,344,725 | 3/1944 | Phipps | 166/178 |
| 2,678,805 | 5/1954 | Sutliff | 166/178 |
| 2,690,226 | 9/1954 | Comstock | 166/145 |
| 2,710,171 | 6/1955 | Bagnell | 166/178 |
| 4,109,736 | 8/1929 | Webb et al. | 175/297 |
| 4,111,271 | 9/1978 | Perkins | 175/297 |
| 4,196,782 | 4/1980 | Blanton | 175/297 |
| 4,200,158 | 4/1980 | Perkins | 175/297 |

FOREIGN PATENT DOCUMENTS

| | | | |
|---|---|---|---|
| 417605 | 7/1974 | U.S.S.R. | 175/297 |

*Primary Examiner*—Stephen J. Novosad
*Assistant Examiner*—William P. Neuder
*Attorney, Agent, or Firm*—Fred A. Winans

[57] ABSTRACT

A hydraulic jarring tool for imparting up-jarring impacts to release a stuck earth boring drill string component is shown. The tool defines upper and lower closed fluid chambers between telescopically moveable concentric cylinders. A fluid metering valve in one fluid passage between the chambers provides limited flow from one chamber to the other and permits telescopic movement at a rate which establishes tension on the drill string and causes the tool to jar. A normally open valve is provided in a by-pass passage between the chambers and is responsive to the fluid velocity therethrough to move to a closed position, restricting fluid flow to pass through the metering valve. However, the tool can be telescopically extended at a somewhat lesser rate insufficient to cause the velocity responsive valve to close thereby permitting the tool to be extended smoothly without a jarring impact.

5 Claims, 2 Drawing Figures

HYDRAULIC JARRING TOOL

BACKGROUND OF THE INVENTION

1. Field of the Invention

This invention relates to a hydraulic jarring tool for earth boring applications and, more particularly, to such a jarring tool having a hydraulic fluid by-pass valve permitting telescopic extension of the tool without a jarring impact being delivered thereby.

2. Description of the Prior Art

Hydraulic jarring tools are tools commonly included in a drill string for drilling oil and gas wells and have a primary function of permitting an up-jarring or sudden impact effect when the drill string is being lifted by the draw works to place the drill string under tension when it is stuck in the hole. The up-jarring impact of the tool is utilized to free the stuck drill string.

To accomplish the up-jarring effect, it is typical for the tool to have two telescopically moveable concentric cylinders defining therebetween an annular sealed chamber containing a hydraulic fluid. The chamber is partitioned by an annular sleeve valve disposed therebetween into an upper hydraulic chamber and a lower hydraulic chamber. A valve in a fluid passage in the sleeve valve permits the fluid to flow from the upper chamber into the lower chamber at a relatively uniform, yet restricted flow rate under pressure from a decreasing volume of the upper chamber as the cylinders are urged to telescope outwardly.

Typically the portion of the drill string which is stuck in the borehole would be below the tool (i.e. at the drill bit) so that lifting the drill string by the draw works, in addition to extending the jarring tool, places the upper portion of the drill string or that portion above the stuck apparatus in tension. By pulling upwardly on the drill string with sufficient force and speed that the hydraulic fluid in the upper chamber cannot flow through the valve at a rate to permit the tool to extend telescopically at the same rate, the drill string is stretched, much like an extended spring. The continued telescopic extension of the tool permits the cylinders to attain a predetermined extended position whereat a fluid path around the sleeve valve is available, permitting a free extended movement of the cylinders therefrom. This permits an immediate release of the stretched drill string which suddenly retracts to cause opposed anvil surfaces in the concentric cylinders to contact under this spring force and provide an up-jarring impact to unstick the drill string.

However, during drilling operations there are often occasions when a component of the drill string becomes stuck in situations that require a downwardly delivered blow or bumping action (as opposed to the above-described up-jarring impact) to free it. On such occasions, an upwardly delivered blow may further exacerbate the stuck condition.

One method of providing a down-jarring or bumping effect on a stuck drill string is to gradually pull upwardly on the string, again to a stretched position, and then suddenly release the brake on the draw works supporting the string, permitting the drill string to retract. After the drill string has retracted a certain distance, as monitored on the drill table, the draw works' brake is engaged to stop the downward motion of the top of the string, thereby imparting a downward impact to the stuck portion of the string. With a jarring tool in the string an additional stroke distance is available for the upper portion of the string to travel to gain velocity and provide greater impact by the amount the two cylinders of the jarring tool have been extended. However, if a jarring tool, such as above-described, is included in the drill string, the upward force to lift the drill string and extend the tool also causes the jarring tool to respond (i.e. fire) as described above, with an upward jarring effect that may be detrimental to the stuck component, or drive it further into a wedged or stuck position. This may ultimately undo the result of any downward bumping being attempted.

SUMMARY OF THE INVENTION

The present invention provides a second or bypass fluid passage from the upper fluid chamber to the lower fluid chamber so that the jarring tool can be extended to its telescopically extended position without a jarring impact being delivered. However, to retain up-jarring capabilities within the tool, a valve is disposed in this bypass passage that is biased to a normally open condition (i.e. permitting generally unrestrictive flow from the upper chamber to the lower chamber) allowing sufficient flow therethrough for relatively rapid extension of the tool, as in instances when it is desired to extend the string for a downward bump without any upward jarring effect.

When an up-jarring effect is desired, the draw works are engaged to lift the string at a rate greater than the rate to just extend the tool without a jarring impact. Such rate of lift requires the hydraulic fluid to flow through the bypass valve at a velocity that places sufficient pressure on the normally open valve to overcome the biasing force and close the valve, thereby eliminating the flow through the bypass passage and causing the tool to respond essentially as if there were no bypass passage in the tool. This requires all hydraulic fluid to flow through the metering valve and appropriately deliver the up-jarring impact as previously described when the cylindrical members attain a specified extended position.

DESCRIPTION OF THE PREFERRED EMBODIMENT

The present invention is an improvement to the hydraulic jarring tool shown and described in U.S. Pat. No. 4,196,782 issued Apr. 8, 1980 and having a common assignee with the present application. As such, the above-identified patent is herein incorporated by reference for its structural and operational description of the hydraulic jarring tool. Such jarring tool, as described therein, is essentially the same as the presently commercially available jarring tool except for a slight rearrangement of the compensating valve 40, as herein described, being in a fluid passage 50, in sleeve body 35, radially aligned with the passage 37.

Figure 1:
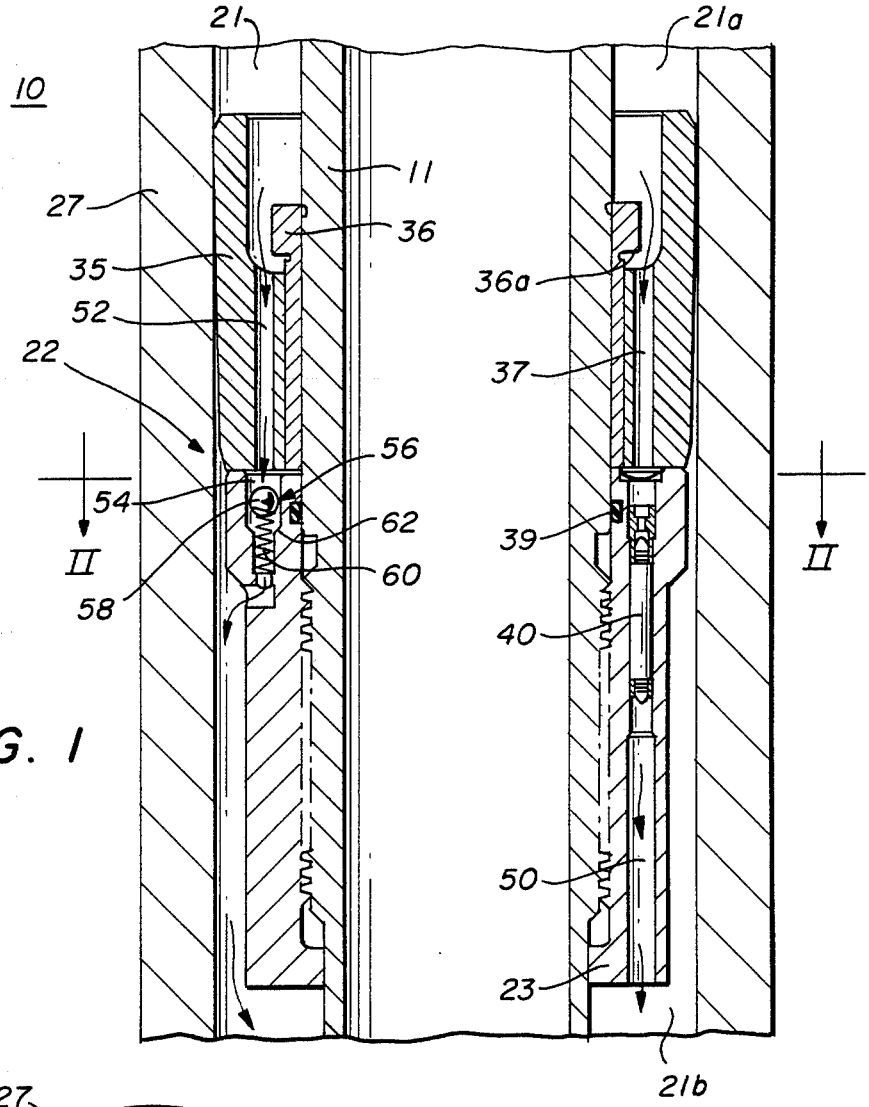
FIG. 1 is an elevational cross-sectional view of the portion of the jarring tool showing the hydraulic fluid chamber between concentric cylinders and partitioned into an upper and lower chamber by a sleeve valve.

Reference is therefore made to FIG. 1 hereof which shows the additional structure to provide the improved hydraulic jarring tool of the present invention. (Reference numbers used herein will correspond to similar structure, particularly in FIG. 2, of the incorporated patent.) As herein seen, the jarring tool 10 includes an outer cylindrical mandrel 27 and a concentric, radially-spaced and axially-moveable inner cylindrical mandrel 11 defining therebetween an annular hydraulic fluid chamber, 21 (closed by upper and lower seal means shown in the incorporated patent). Hydraulic fluid chamber 21 is separated into an upper chamber portion 21*a* and a lower chamber portion 21*b* by an annular sliding sleeve valve detent actuation means 22 threaded to inner mandrel 11 and in sliding generally fluid sealed engagement with outer mandrel 27.

Specifically, the annular sliding sleeve valve detent actuation means 22 comprises an upper annular sleeve valve body 35 having an outer wall engaging the outer mandrel 27 and an axial fluid passage 37 therethrough, and a lower annular stop member 23, threaded to the inner mandrel 11 and also defining an axial fluid passage 50 in communication with passage 37. A temperature compensating valve 40 is disposed in fluid passage 50 to maintain a generally constant metered fluid flow rate through the two passages from the upper chamber to the lower chamber.

A retainer sleeve 36, having an upper radially-projecting lip 36*a*, permits limited axial sliding of the body 35 with respect to the inner mandrel 11 between abutment of the lip 36 and abutment with the stop member 23 so that, during telescopic collapsing motion of the tool an axial gap is provided between the sleeve valve body 35 and the stop member 23 whereby reverse flow of the hydraulic fluid from the lower chamber to the upper chamber is not required to flow through the temperature compensating valve 40. (For purposes of reference, when the tool is telescopically extended, inner cylinder 11 moves upwardly with respect to outer cylinder 27, and when the tool is collapsed, inner cylinder 11 moves downwardly with respect to outer cylinder 27.)

In accordance with the present invention a second axially extending fluid passage 52 is formed through sleeve valve body 35 and a short bypass passage 54, in communication therewith, extends through a portion of the lower stop member 23 to place the lower fluid chamber 21*b* in hydraulic fluid flow communication with the upper fluid chamber 21*a* through these two passages. A valve mechanism 56 is disposed in passage 54 and includes a ball 58 biased by a spring 60 to a normally open position above a chamfered bore wall 62 in passage 54 comprising a valve seat. The ball 58 has a diameter sufficient to engage the valve seat 62 in a fluid sealed relationship but slightly smaller than the diameter of the upper portion of passage 54 so that the hydraulic fluid can flow in the annular area between the ball 58 and the passage 54.

Operationally, when the drill string having a jarring tool according to the present invention, becomes stuck in the borehole, either an up-jarring impact can be delivered or a down-bumping action can be delivered from an extended jarring tool without the necessity of an up-jarring effect when the tool is brought to its extended condition.

Assuming an up-jarring action is desired, the draw works are raised at a rate faster than the hydraulic fluid can be displaced from the upper chamber to the lower chamber (as shown by arrows on FIG. 1) through the temperature compensating restricting valve 40. However, hydraulic fluid is also permitted to flow from the upper chamber 21*a* to the lower chamber 21*b* through passages 52, 54 and valve means 56. Fluid flow in this direction is restricted between the ball 58 and the wall of passage 54, establishing a pressure differential across the ball 58. When this pressure differential acting on the effective area of the ball exceeds the spring force of spring 60, the ball 58 is forced into sealing engagement on valve seat 62 preventing further fluid flow through passage 54. Thus, tensioning the drill string at this rate eliminates fluid flow through this bypass passage and tensions and stretches the drill string until the sleeve valve 35 is axially moved to a fluid release position as described in the incorporated patent, whereupon the cylinders are free to extend under this force to engage opposed anvil surfaces to deliver an up-jarring impact to the portion of the string below the tool.

However, assuming it is desirable to telescopically extend the jarring tool without an up-jarring impact, the rate of raising the draw works is thus at a sufficiently slower rate such that the velocity of fluid flow from the upper chamber 21*a* to the lower chamber 21*b* through the bypass passage 52, 54 as the tool is being extended, is insufficient to establish a pressure differential on the ball 58 to move it to a sealed position within passage 54. Thus, the tool can be axially telescopically extended, although at a slightly slower rate, to a fully extended position without delivering an up-jarring impact and from which position, further lifting by the draw works tensions the drill string in a manner previously described so that upon release and subsequent braking of the draw works, a downward bumping impact is delivered to free the drill string below the tool 10.

It is seen that the valve 56, in essence, acts as a velocity check valve for the hydraulic fluid when the tool is being extended so that, depending upon the rate of extension which ultimately determines the velocity through the valve 56, the tool either delivers an upward impact or extends smoothly without delivering such impact.

Figure 2:
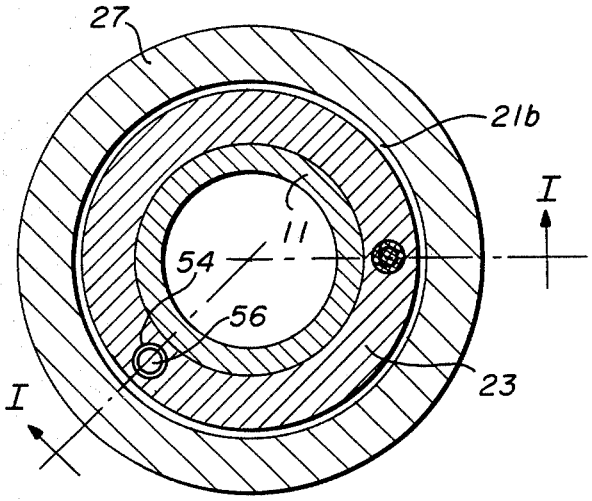
FIG. 2 is a cross-sectional plan view along line II—II of FIG. 1.

Reference is made to FIG. 2 wherein it is seen that passage 50 containing the temperature compensating restricted flow valve 40 is disposed generally on one side of the stop member 23 and the bypass passage 54 containing the ball 56 is disposed on generally the opposite side of stop member 23. However, there is no particular significance to the relative placement of the two flow passages with respect to one another.

It is to be understood that in the same manner that valve 40 is bypassed by the fluid flow path when the concentric cylinders of the tool are being moved to a collapsed position, passage 54 containing the valve 56 is bypassed.

The embodiments of the invention in which an exclusive property or priviledge is claimed are defined as follows:

1. An improved hydraulic jarring tool comprising:

an outer cylindrical member;

an inner cylindrical member disposed in spaced relationship therein and defining a closed chamber therebetween containing an operating fluid;

sleeve valve means partitioning said chamber into an upper chamber and a lower chamber, said means being axially driven by one of said members and in sliding sealing engagement with the other whereby relative axial movement of said members changes the volume of each said upper and lower chamber;

a first fluid passage in said sleeve valve means for fluid flow communication between said upper and lower chambers and a flow restriction means in said first passage permitting metered fluid flow during said relative axial movement; the improvement comprising:

a second fluid passage in said sleeve valve means for fluid communication between said upper and lower chambers during said relative axial movement, said second passage containing a normally open valve means responsive to a predetermined fluid velocity therethrough for closing said second passage and wherein said sliding sealing engagement between said sleeve valve and said other member becomes open at a predetermined axial location of said sleeve valve, to permit relatively free flow between said upper and lower chamber as the members are moved in a relatively axial direction and said fluid flow velocity through said second fluid passage is dependent upon the rate of relative movement of said members to said predetermined axial location whereby such rate of relative axial movement determines the condition of said normally open valve means.

2. Structure according to claim 1 wherein said normally open valve comprises a valve member disposed in said second passage and normally biased away from a reduced diameter continuation of said second passage by a spring during said relative axial movement to upstream of said reduced diameter and wherein said spring is collapsed for sealing engagement of said valve member on said reduced diameter continuation when the fluid pressure differential across said valve member acting on the projected area of said valve member exceeds the biasing force of said spring.

3. Structure according to claim 2 wherein said second fluid passage extends through said sleeve valve.

4. Structure according to claim 3 wherein said sleeve valve comprises a pair of axially stacked upper and lower annular members and wherein said second fluid passage comprises openings in fluid communication through each sleeve valve member, said members being in abutting engagement during relative extension of said cylindrical members, and said driving engagement between said one cylindrical member and said upper sleeve member permits an axial gap during retraction of said cylindrical members from an extended position providing fluid flow communication from said upper chamber to said lower chamber through the opening in said upper sleeve member.

5. Structure according to claim 2 wherein said normally open valve means is disposed in the portion of said opening in said lower sleeve valve member.

* * * * *